US005718396A

United States Patent [19]

Maresca

[11] Patent Number: 5,718,396

[45] Date of Patent: Feb. 17, 1998

[54] MATERIAL ROLL HOLDER HAVING L-SHAPED MOVABLE ARM

[76] Inventor: Anthony S. Maresca, 25 Eaton Pl., Deer Park, N.Y. 11729

[21] Appl. No.: 708,539

[22] Filed: Sep. 5, 1996

[51] Int. Cl.[6] ..... B65H 16/04

[52] U.S. Cl. ..... 242/598.2

[58] Field of Search ..... 242/598.1, 598.2, 242/591, 599, 599.1, 599.3, 129.6, 129.62; 403/84, 87, 91, 97, 99, 101, 102

[56] References Cited

U.S. PATENT DOCUMENTS

| | | | |
|---|---|---|---|
| 179,463 | 7/1876 | Perry . | |
| 365,158 | 6/1887 | Duzer | 403/97 X |
| 760,133 | 5/1904 | Levy . | |
| 1,156,266 | 10/1915 | Bens et al. . | |
| 1,301,475 | 4/1919 | Mellin | 403/84 X |
| 1,665,739 | 4/1928 | Hoegger . | |
| 1,889,024 | 11/1932 | Marsh | 242/598.1 |
| 2,466,957 | 4/1949 | Lewis | 242/598.1 |
| 2,517,809 | 8/1950 | Tarzian . | |
| 3,022,957 | 2/1962 | Blunt et al. | 242/598.2 |
| 3,051,404 | 8/1962 | Ritchey . | |
| 3,297,265 | 1/1967 | Turro . | |
| 3,304,034 | 2/1967 | Jones . | |
| 3,788,573 | 1/1974 | Thomson et al. . | |
| 3,823,990 | 7/1974 | Johnson et al. . | |
| 4,186,905 | 2/1980 | Brudy | 403/97 X |
| 4,416,425 | 11/1983 | Kish | 242/598.1 |
| 4,483,491 | 11/1984 | Rainey . | |
| 4,824,038 | 4/1989 | Chandler | 242/598.2 |
| 4,858,840 | 8/1989 | Kidman . | |
| 4,913,365 | 4/1990 | Shamass . | |
| 5,163,771 | 11/1992 | Bremer et al. | 403/97 |
| 5,305,661 | 4/1994 | Schartman et al. | 403/84 X |
| 5,564,852 | 10/1996 | Maxwell et al. | 403/97 |

FOREIGN PATENT DOCUMENTS

| | | | |
|---|---|---|---|
| 1336333 | 7/1963 | France | 403/97 |

*Primary Examiner*—Daniel P. Stodola
*Assistant Examiner*—William A. Rivera
*Attorney, Agent, or Firm*—Collard & Roe, P.C.

[57] ABSTRACT

A material roll holder which is hinged at one end snaps into a socket at the other end, and is held either by spring retention, friction holding, or be another holder. The bar which holds the material roll swivels upwardly out of the socket to an intermediate position substantially 45 degrees above horizontal, and then holds in place so that the dispensed roll can be removed and a new roll can be inserted.

5 Claims, 3 Drawing Sheets

MATERIAL ROLL HOLDER HAVING L-SHAPED MOVABLE ARM

BACKGROUND OF THE INVENTION

1. Field of the Invention

The present invention relates to a material roll holder which is hinged at one end and snaps in at the other end, either by spring retention, friction holding, or by other retaining gripping means. The bar which holds the roll of material swivels upwardly out of a socket which has the retaining means, so that the dispensed roll can be removed and a new roll can be inserted.

2. Prior Art

It is known in the prior art to provide paper roll holders of different sizes and configurations adapted for rotatably supporting a roll of toilet paper thereon. Such normally require that an individual insert his hand into a restricted area to release the roll on which the toilet paper is suspended. Prior proposals are as follows.

The Jones U.S. Pat. No. 3,304,034 discloses a spindle that is adapted to fit into a recessed opening at the ends of the holder which includes springs that retain the spindle from accidentally falling out.

The Hoegger U.S. Pat. No. 1,665,739 shows a paper holder having a pair of posts having rounded outer head portions, one of which has a socket and the other of which is held to turn on the body of a post, and a spring loaded member for engaging the socket and holding the paper within.

The Bens & Hubbard U.S. Pat. No. 1,156,266 shows a T-shaped member which is received in a receptacle arm to releasably support the end of a movable arm.

The Thomson U.S. Pat. No. 3,788,573 discloses a roll paper dispenser in which the roll is directly inserted or removed from an open end of the rotatable spindle, with the roll being retained on the spindle by ribs which are slightly over-size the internal diameter of the paper roll.

The Perry Patent U.S. Pat. No. 179,463 discloses a device for adjusting spindles, in which S-shaped surfaces are provided to releasably hold the roll holder at a plurality of positions.

The Levy U.S. Pat. No. 760,133 shows a cloth holding device which is in the combination of a base plate provided with a cam surface and having a vertically projecting stem.

None of the above references show a material roll holder having an S-shaped or sinusoidal interface between a bracket and an L-shaped rotatable arm which allows the arm to rotate around the bracket from a horizontal position to a point approximately 45 degrees above horizontal and then remain there. This improvement is important because at that angle, it allows a user to easily remove a spent roll from the roll holder and replace the spent roll with a new roll. Once the new roll is on the arm, the arm is then rotated back around to the original horizontal position.

SUMMARY OF THE INVENTION

It is an object of the invention to provide a holder for a roll of solid material which is simplified and compact in construction, neat and attractive in appearance, and reliable and efficient in operation.

It is another object of the present invention to provide a simple and efficient material roll holder which facilitates the insertion of as well as the removal of a roll of material onto and off of the holder.

The invention relates to a holder for a roll of solid material which is hinged at one end and snaps in at the other end, either by spring retention, friction holding, or other retaining gripping means. The bar which holds the material roll actually swivels upwardly out of a socket which has a retaining means, so that the dispensed roll can be removed and a new roll can be inserted. The pivot, or hinged arrangement, of the roll holder is such.that one end of the spindle is pivotally connected to a first bracket located on the front face of the frame and the other spindle end can snap into this socket because it is so shaped that there is a mating engagement between the socket and the spindle end.

The above objects are achieved according to the present invention by providing a material roll holder comprising a back plate having a front surface. Attached to the front surface is a first bracket wherein the bracket extends on a substantially perpendicular axis from the front surface to an end having a S-shaped or sinusoidal contoured surface.

The roll holder further comprises an L-shaped movable arm having a first member spaced substantially parallel to the front surface. On the arm, a second member integrally attaches to the first member in a substantially perpendicular manner. The second member has an end with a S-shaped or sinusoidal contoured surface for mating with the S-shaped end on the first bracket. The L-shaped arm has an end on the first member which is immovable and T-shaped. Within the arm, there is a rotatable connector means for joining the first bracket with the second member of the L-shaped movable arm.

The roll holder also has an elongated second bracket spaced in a substantially parallel manner from the first bracket. The second bracket extends on a substantially perpendicular axis from the front surface wherein the second bracket has a T-shaped receptacle being a retention means for receiving the end portion of the L-shaped movable arm, so that when the first member rotates around the longitudinal axis from a substantially horizontal position to a position substantially 45 degrees above the horizontal position, it can receive rolled material and then the movable arm can rotate back to the horizontal position with the T-shaped end inserting into the T-shaped receptacle.

BRIEF DESCRIPTION OF THE DRAWINGS

Other objects and features of the present invention will become apparent from the following detailed description considered in connection with the accompanying drawing which discloses three embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
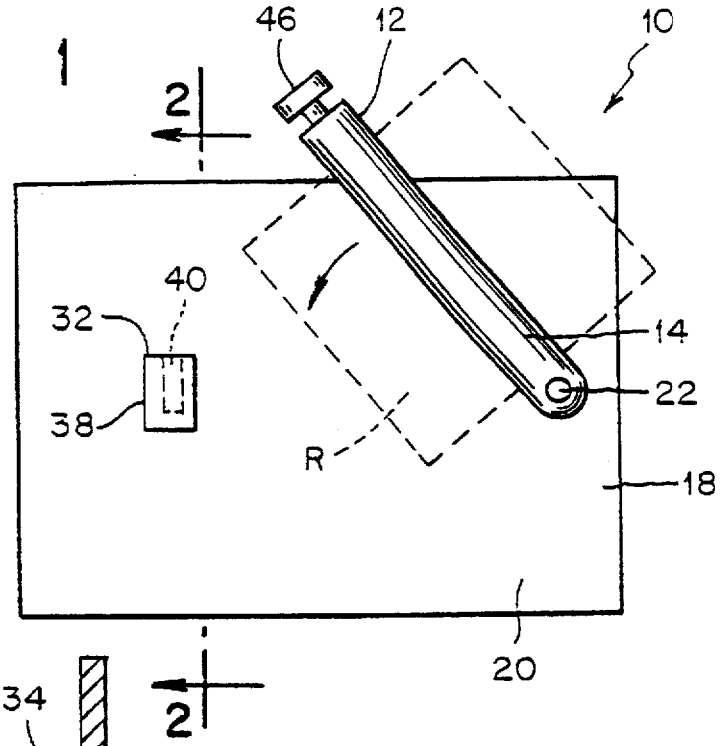
FIG. 1 shows a front view of the material roll holder according to the invention.
Figure 3:
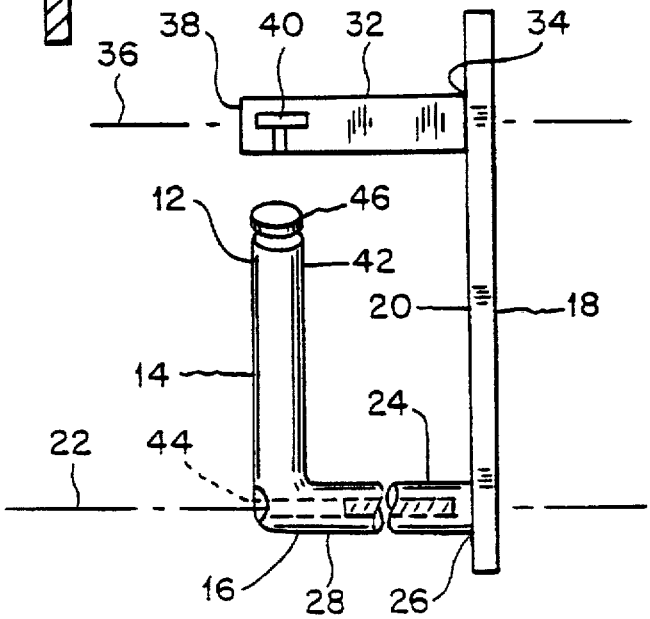
FIG. 3 shows a top view of the material roll holder of FIG. 1.

Turning now in detail to the drawings, FIG. 1 shows a material roll holder 10 comprising an L-shaped spindle moveable arm 12, having a first member 14 integrally joined to a second member 16 (FIG. 3). A back plate 18 has a front surface 20 with first member 14 parallel to the front surface. Back plate 18 has an axis 22 perpendicular to front surface 20, and axis 22 is the longitudinal axis of second member 16.

Figure 2:
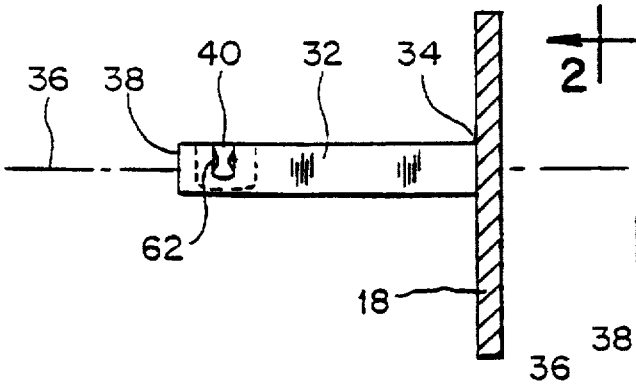
FIG. 2 shows a section view, taken along the lines 2—2, of FIG. 1.

As shown in FIG. 2, plate 18 also has a second bracket bar 32 with one end 34 attached to the plate. Bar 32 has a longitudinal axis 36 parallel to axis 22 of second member 16.

FIG. 3 shows that bar 32 has a second end 38 having a T-shaped receptacle 40. Bar 32 is a spaced distance from a first bracket 24, with this distance equal to the length of first member 14. First member 14 has a first end 42 and a second end 44. First end 42 of first member 14 has an immovable T-shaped connector means 46 for mating attachment into T-shaped receptacle 40 of stationary elongated bracket 32.

First bracket 24 has a stationary end 26 attached to back plate 18 coaxial with perpendicular axis 22. First bracket 24, extends from back plate 18 to a S-shaped or sinusoidal contoured end piece 52 (FIG. 4).

Figure 4:
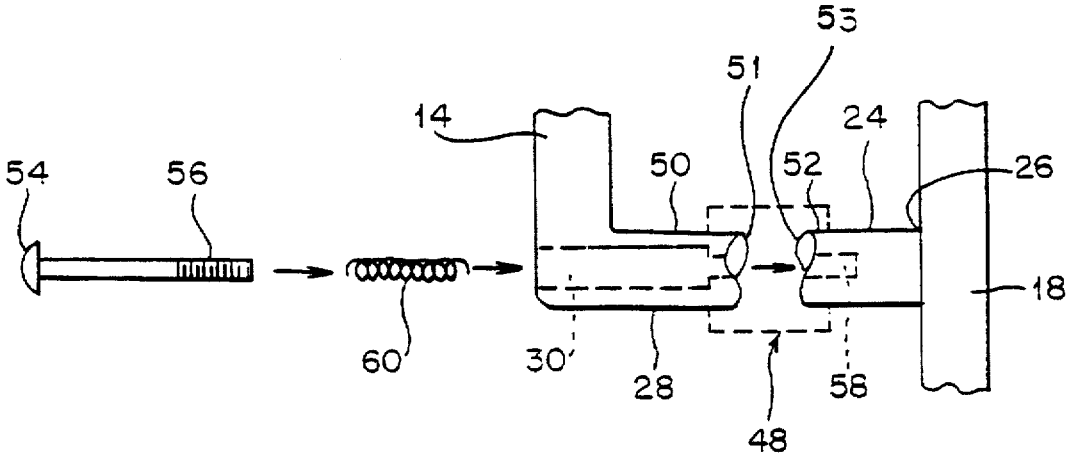
FIG. 4 shows an exploded view of the horizontal arm of the material roll holder of FIG. 3.

As shown in FIGS. 3 and 4, second member 16 has an S-shaped or sinusoidal contoured end piece 50 interfacing with S-shaped or sinusoidal contoured end piece 52 of first bracket 24 at point 48. Two end pieces 50 and 52 are joined by rotatable connector means 54 fitted within receptacle 30 of second member 16. Rotatable connector means 54 includes a screw means 56 held within an internally-screw-threaded cavity shaft 58. Rotatable connector means 54 further includes a spring 60 surrounding screw means 56 within shaft 58 of bracket 24.

To replace spent rolls, connector means 46 can be withdrawn from receptacle 40, and then movable arm 12 can be rotated around longitudinal axis 22 between a lockable position in receptacle 40, to a intermediate position approximately 45 degrees above horizontal. (see FIG. 1). At that angle, two faces 51 and 53 of S-shaped ends 50 and 52 mate, and arm 12 is retained in that position by axial tension caused by spring 60. When arm 12 is rotated at that angle, a spent roll can be removed from arm 12, and a new roll placed on that arm. To rotate arm 12 back to its original position, the S-shaped interfaces 51 and 53 disengage and the L-shaped movable arm moves opposite the tension of spring 60. Next, the arm rotates back toward second bracket 32 such that connector 46 can be reinserted into receptacle 40 and locked into place by the retaining or retention means discussed below.

Figure 5:
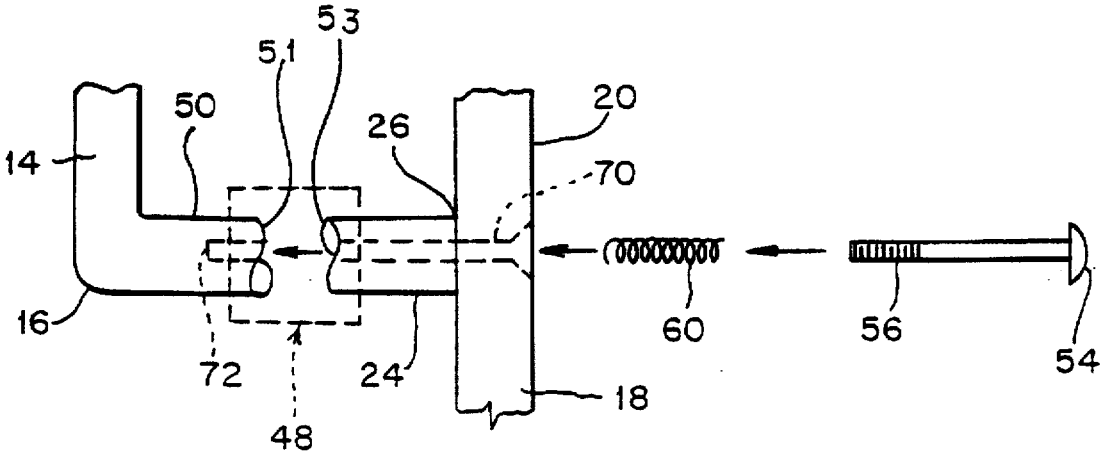
FIG. 5 shows an exploded view of a second embodiment of the horizontal arm of the material roll holder.

FIG. 5 shows a second embodiment in which second member 16 has an end portion 50 having an S-shaped interface which joins with end portion 52 of first bracket 24 at interface point 48. Both ends are joined by rotatable connector means 54 fitted within receptacle 70 of back plate 18.

Rotatable connector means 54 includes a screw means 56 held within an internally-screw-threaded cavity shaft 72. Rotatable connector means 54 further includes a spring 60 surrounding screw means 56 within shaft 72. First bracket 24 has stationary end 26 attached to back plate 18 and has rotatable end 28 containing shaft 72 within second section 50 of L-shaped member 12.

As shown in FIG. 2, receptacle 40 in bar 32 has a retention means which could be a pair of coacting springs 62.

Figure 6:
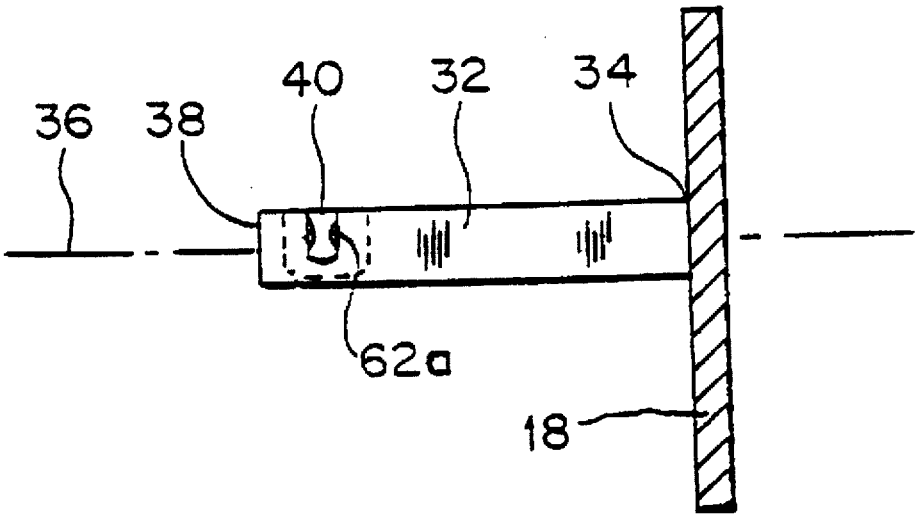
FIG. 6 shows a second embodiment of the invention in section view, taken along the lines 2—2 of FIG. 1.

As shown in FIG. 6, receptacle 40 in bar 32 has a retention means which could be a pair of coacting friction surfaces **62*a***.

The material of which roll R is comprised may be any solid or web material, such as carpeting or cloth; metal sheet or foil, for example, aluminum foil; paper, for example toilet paper or paper towels; and plastic.

The material roll holder could be made of metal, such as brass, aluminum, or steel, or made of wood, or made of plastic, such as both thermoplastic or thermosetting resin, for both the movable parts and the stationary parts. The material roll holder can be produced by known manufacturing techniques and procedures.

While several embodiments of the present invention have been shown and described, it is to be understood that many changes and modifications may be made thereunto without departing from the spirit and scope of the invention as defined in the appended claims.

What is claimed is:

1. A material roll holder comprising:

a back plate having a front surface;

a first bracket having a first end fixed to said front surface wherein said bracket extends on a substantially perpendicular axis from said first end on said front surface to a second end having an S-shaped contoured surface;

an L-shaped movable arm having a first member spaced substantially parallel to said front surface, a second member integrally attached to said first member in a substantially perpendicular manner, with said second member having an end with an S-shaped contoured surface, said arm having an end on said first member which is immovable and T-shaped;

a rotatable connector means for joining said first bracket with said second member of said L-shaped movable arm so that the S-shaped contoured surfaces of said first bracket and said L-shaped arm contact each other; and an elongated second bracket spaced in a substantially parallel manner from said first bracket extending on a substantially perpendicular axis from said front surface wherein said second bracket has a T-shaped receptacle having a retention means for receiving said end portion of said L-shaped movable arm, wherein when a roll is replaced on said roll holder, said end portion of said movable arm is removed from said receptacle, said L-shaped arm rotates around a longitudinal axis from a substantially horizontal position to a position substantially 45 degrees above said horizontal position, said S-shaped surface of said first bracket mates with said S-shaped contoured surface of said second member at a first interface to hold said L-shaped arm in place at said substantial 45 degree position, so that a spent roll can be replaced on said L-shaped arm, and said L-shaped arm can then be rotated back to its horizontal position with its T-shaped end reinserted into said T-shaped receptacle, and said first interface is disengaged.

2. The material roll holder of claim 1, wherein said rotatable connector means comprises a screw-threaded cavity and a screw in said cavity.

3. The material roll holder of claim 2, wherein said rotatable connector means further comprises a spring surrounding said screw within said cavity.

4. The material roll holder of claim 1, wherein said T-shaped receptacle retention means comprises a pair of coacting springs.

5. The material roll holder of claim 1, wherein said T-shaped receptacle retention means comprises a pair of coacting friction surfaces.

* * * * *